US009820549B2

(12) United States Patent
Liard

(10) Patent No.: US 9,820,549 B2
(45) Date of Patent: Nov. 21, 2017

(54) CONTAINER FOR A COSMETIC PRODUCT, IN PARTICULAR FOR A STICK OF COSMETIC PRODUCT

(71) Applicant: ALBEA SERVICES, Gennevilliers (FR)

(72) Inventor: Jérôme Liard, Sainte-Jamme-sur-Sarthe (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/105,711

(22) PCT Filed: Dec. 19, 2014

(86) PCT No.: PCT/EP2014/078888

§ 371 (c)(1),
(2) Date: Jun. 17, 2016

(87) PCT Pub. No.: WO2015/092031

PCT Pub. Date: Jun. 25, 2015

(65) Prior Publication Data

US 2016/0324296 A1 Nov. 10, 2016

(30) Foreign Application Priority Data

Dec. 20, 2013 (FR) ..... 13 63146

(51) Int. Cl.
*B43K 5/12* (2006.01)
*A45D 40/06* (2006.01)
*A45D 40/00* (2006.01)

(52) U.S. Cl.
CPC ..... *A45D 40/06* (2013.01); *A45D 40/00* (2013.01); *A45D 2040/0012* (2013.01);
(Continued)

(58) Field of Classification Search
CPC ..... A45D 40/06; A45D 2200/052; A45D 2200/053; A45D 2040/0012; A45D 2040/0031
See application file for complete search history.

(56) References Cited

U.S. PATENT DOCUMENTS 5,538,161 A 7/1996 Koehler et al.
5,715,961 A * 2/1998 Robertson ..... A45D 40/00 132/318

(Continued)

FOREIGN PATENT DOCUMENTS

EP 0597591 A1 5/1994
FR 2891710 A1 4/2007

(Continued)

OTHER PUBLICATIONS

Feb. 4, 2015—Translation of the International Search Report of PCT/EP2014/078888.

*Primary Examiner* — Jennifer C Chiang
(74) *Attorney, Agent, or Firm* — Banner & Witcoff, Ltd.

(57) ABSTRACT

A container (10) for a cosmetic product, in particular for a stick of cosmetic product, has a body (20) and a cup (40) that is movable relative to the body (20), the cup (40) being suitable for receiving the product. The body (20) has a transparent portion (30) that makes it possible to see the cup (40) in a position in which the cup is retracted inside the body (20). An assembly of the above-mentioned container (10) and of the product, wherein the cup (40) provides information relating to the product.

9 Claims, 2 Drawing Sheets

Figure 1:
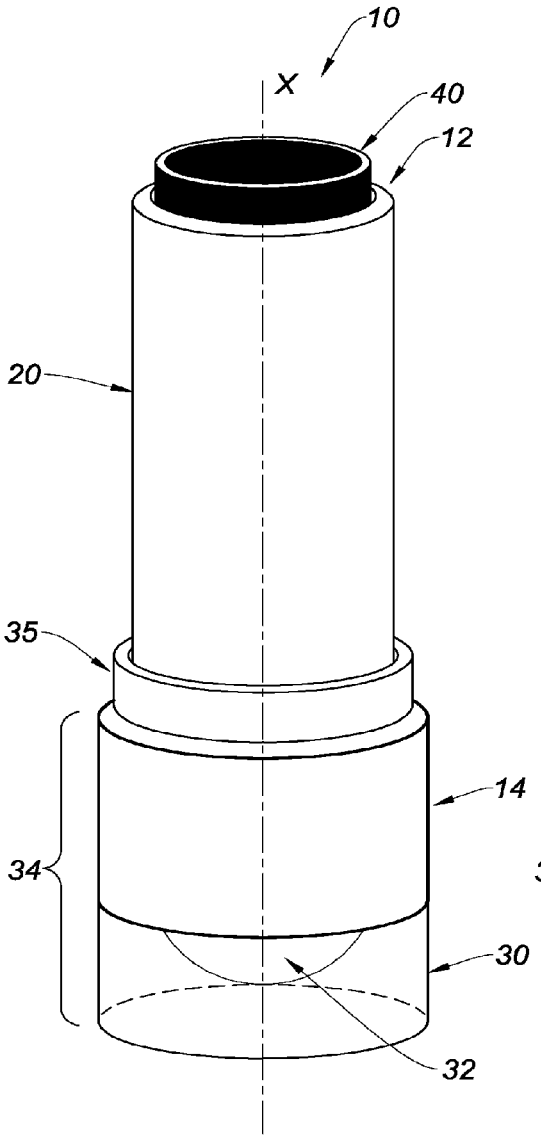

(52) U.S. Cl.
CPC ..... *A45D 2040/0031* (2013.01); *A45D 2200/052* (2013.01); *A45D 2200/053* (2013.01)

(56) References Cited

U.S. PATENT DOCUMENTS

| | | | | |
|---|---|---|---|---|
| 6,561,711 | B1 * | 5/2003 | Pierpont ..... | A45D 40/06 401/192 |
| 2009/0052971 | A1 | 2/2009 | Pires et al. | |

FOREIGN PATENT DOCUMENTS

| | | | |
|---|---|---|---|
| GB | 2388587 | A | 11/2003 |
| KR | 1567930 | B1 * | 11/2015 |

* cited by examiner

CONTAINER FOR A COSMETIC PRODUCT, IN PARTICULAR FOR A STICK OF COSMETIC PRODUCT

CROSS-REFERENCE TO RELATED APPLICATIONS

The present application is a U.S. National Phase filing of International Application No. PCT/EP2014/078888, filed on Dec. 19, 2014, designating the United States of America and claiming priority to French Patent Application No. 1363146 filed Dec. 20, 2013. The present application claims priority to and the benefit of all the above-identified applications, which are all incorporated by reference herein in their entireties.

The field of the invention is that of cosmetic product packaging. The invention relates more particularly to a container for a cosmetic product, in particular for a stick of cosmetic product, more particularly lipstick.

It is known to provide containers of this kind with a body, a mechanism for moving a cup relative to the body, said cup supporting a stick of cosmetic product. The movement mechanism is formed by the body and a guide that is mounted in said body. Said mechanism makes it possible to move the cup in order to retract the stick of cosmetic product inside the container or to extend it therefrom in order to make it accessible to a user wishing to apply make-up using said product.

Furthermore, it is known to close containers of this kind by means of a removable cap. Said cap makes it possible to protect the constituent parts of the container from a hostile external environment (dust, impacts). Said cap protects, inter alia, the mechanism for moving the cup, the cup, and the cosmetic product.

The known containers and caps are opaque. A user wishing to know what is inside the container must therefore remove the cap from the container in order to see what is inside.

In order to overcome this disadvantage, manufacturers of packaging for cosmetic products provide an indication on the outside of the container and/or of the cap. However, this type of indication has a number of disadvantages.

One disadvantage consists in providing one or more additional steps when manufacturing containers of this kind and/or caps of this kind, in order to apply one or more indicators.

Another disadvantage is the fact that indicator elements of this kind fade or even disappear over time.

An object of the present invention is that of proposing a container for a cosmetic product that permits the user to know what is inside, without having the disadvantages of the prior art.

The invention therefore relates to a container for a cosmetic product, in particular for a stick of cosmetic product, comprising a body and a cup that is movable relative to the body, the cup being suitable for receiving the product, said body comprising a transparent portion that makes it possible to see the cup in a position in which said cup is retracted inside the body.

On account of said transparent portion, the container according to the invention makes it possible to see the cup. The container according to the invention thus has the advantage of allowing the user to know what is inside the container without the manufacturer needing to apply an indication to the outside of the container. The user can thus know which cosmetic product is contained by the container according to the invention without having to remove a cap which may be present. The invention furthermore makes it possible to protect the indication provided, since said indication is located inside the container.

Advantageously, the packaging for storing the container on the shelf does not need to bear any indication either. Indeed, the user will be informed about the contents of the container by means of the transparent portion thereof, and no longer by means of an indication provided on the shelf packaging thereof.

In addition, the shelf packaging can remain intact, in particular during sale. Indeed, the container according to the invention makes it possible to prevent any damage to said packaging that may occur, for example, when a future user is unsure about the contents of the container and wishes to find out by tearing the shelf packaging.

Advantageously, said container is designed to allow the product to occupy a position, in particular outside the body at least in part, in which the user can apply said product by handling said body.

According to various embodiments of the invention, which may be taken together or separately:

- said container further comprises a cap designed to cover said body, in particular by concealing said product and leaving said transparent portion visible,
- said container further comprises a mechanism for moving the cup, referred to as the actuation mechanism of the container,
- said container is designed so as to allow the cup to occupy a first position, referred to as the high position, that is outside the body at least in part, and a position, referred to as the low position, that corresponds to the position in which the cup is visible through said transparent portion,
- in the low position, the cup is radially visible through said transparent portion,
- the actuation mechanism is designed to move the cup from the high position to the low position,
- the actuation mechanism is designed to cause the cup to rotate and/or translate relative to the body,
- said container further comprises a blind part at its proximal end, the blind part being designed in order for the cup to occupy said low position close to said blind part,
- said container is designed such that said cup abuts said blind part in said low position,
- said blind part comprises the transparent portion of the container, or is even formed by said transparent part,
- the cup comprises two parts,
- the cup comprises a first part, referred to as the lower cup, that is designed to cooperate with the actuation mechanism, and a second part, referred to as the upper cup, that is suitable for receiving the product,
- the lower and upper cups are removable from one another,
- said two parts are connected and/or disconnected by means of elastic deformation of a portion of one of said two parts by the other part,
- the lower and upper cups are connected and/or disconnected by means of elastic deformation of a portion of the lower cup, and respectively of the upper cup, by the upper cup, and respectively the lower cup, in one or more directions tangential to said upper cup, and respectively said lower cup,
- said two parts are connected and/or disconnected by snapping a portion projecting from the upper cup, and respectively from the lower cup, into a hollow portion of the lower cup, and respectively of the upper cup.

The invention further relates to an assembly of the container as described above and of said product, said cup providing information relating to said product.

For this purpose, said cup is advantageously the same colour as the product, in particular in the case of sticks of lipstick. Said cup can in particular be mass-coloured.

Figure 2:
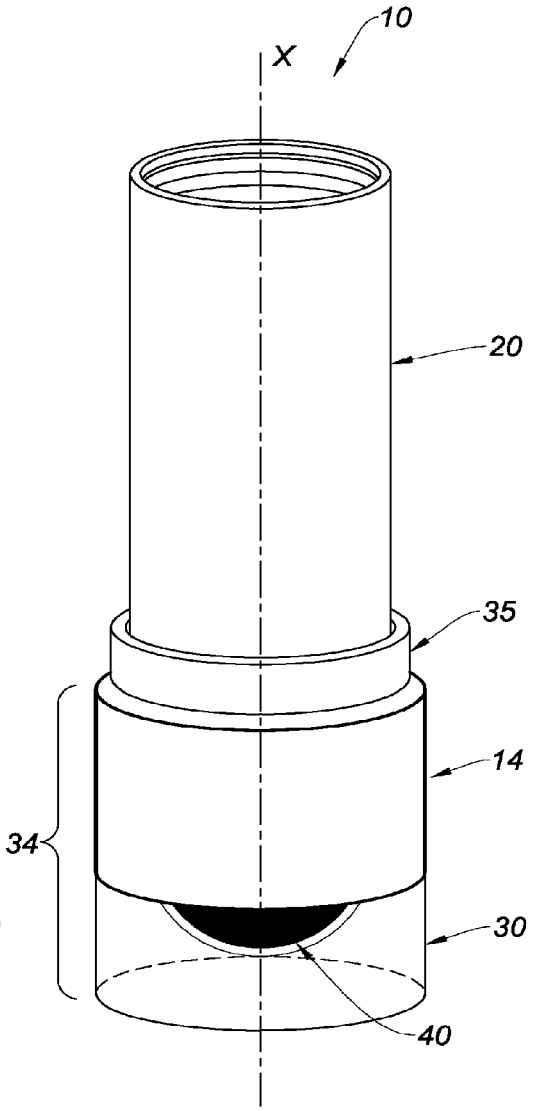
Figure 3:
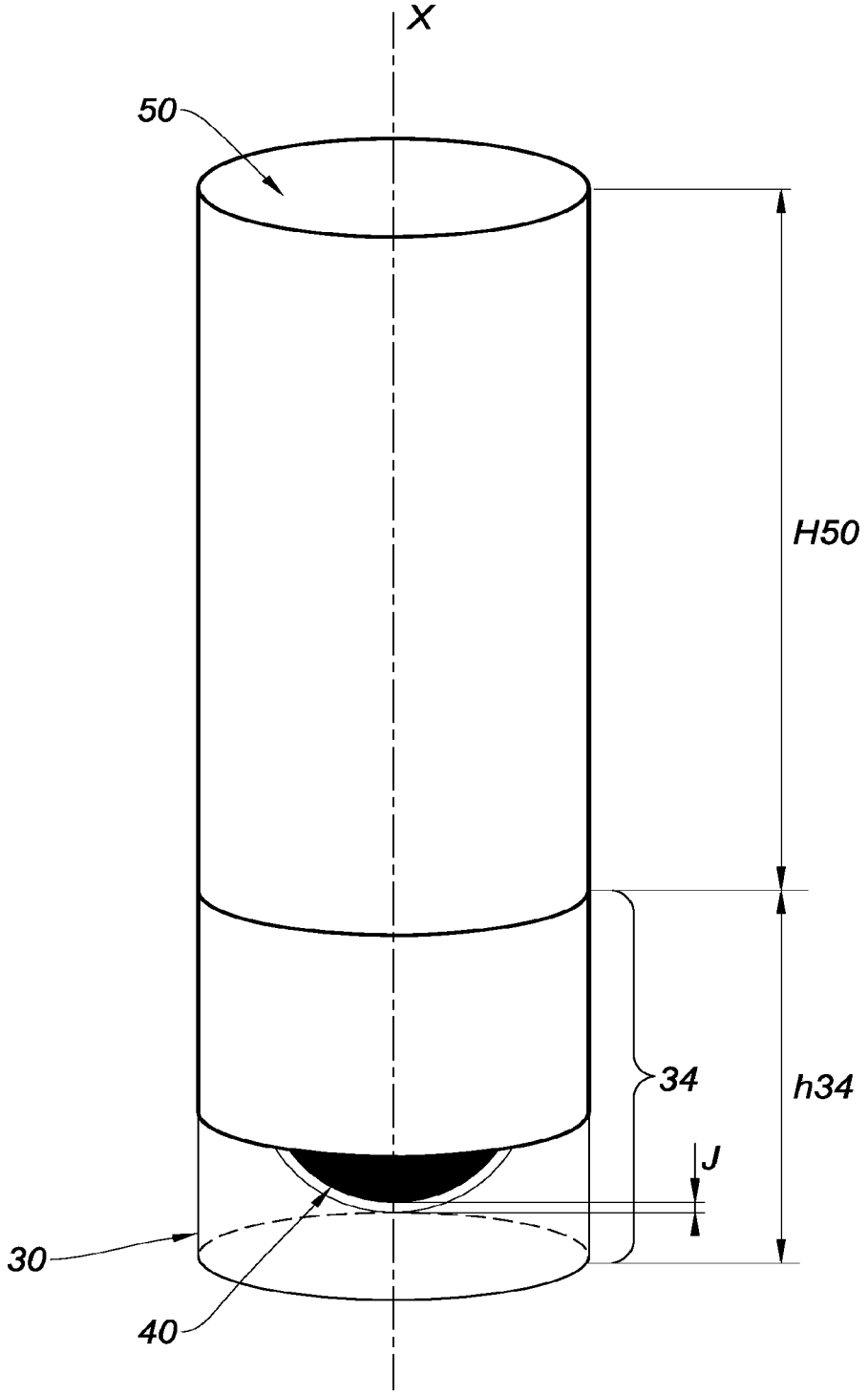

The invention will be better understood, and its other aims, details, features and advantages will become clearer in the following detailed explanatory description of at least one embodiment of the invention given as a purely illustrative and non-limiting example, with reference to the accompanying schematic drawings, in which:

FIG. 1 is a perspective view of an embodiment of a container according to the invention, a cup of said container being shown in a first position, FIG. 2 shows the container from FIG. 1, the cup being located in a second position, FIG. 3 shows the container from FIG. 2, covered by a cap.

The invention relates to a container 10 for a cosmetic product. In this case, the cosmetic product is a stick of cosmetic product, for example a stick of lipstick (not shown).

The container 10 according to the invention comprises a body 20 (see FIG. 1). Said body 20 is provided in a rigid form. This means that it cannot be deformed by a pressure exerted by the user's fingers. Said body 20 is produced by moulding, in particular from a plastics material. Said body can also be coated with a layer of material in order to protect it, or even to decorate it, for example with a layer of metallic material. Said body 20 can also be entirely moulded from a metallic material, for example aluminium.

The body 20 shown here has a substantially circular cross section. However, this in no way excludes bodies 20 having complex cross sections (polygonal, compound shapes having circular and straight portions, etc.) that are intended to receive sticks of lipstick having a similar cross section.

The container 10 according to the invention is designed to allow the product to occupy a first position that is outside the body 20 at least in part, and in which position the user can apply said product by handling said body 20. FIG. 1 shows the container 10 in an arrangement that makes it possible for the product to occupy this first position. The container 10 further comprises a cup 40. In the arrangement in FIG. 1, the cup 40 is extended in part, relative to the body 20.

Said cup 40 is suitable for receiving the product and is provided so as to be movable relative to the body 20. The cup 40 can be coloured, advantageously in the same colour as said product. Said cup can, in particular, be mass-coloured. Said cup 40 is rigid and obtained by moulding, preferably from a plastics material. Furthermore, said cup has a cross section that is similar to that of the body 20 in order to ensure that said cup is movable inside said body 20.

It should be noted that the container 10 advantageously extends in a main longitudinal extension direction, referred to as the main direction and shown schematically by the axis X in FIGS. 1 to 3. The container 10 thus has a first end, referred to as the distal end 12 of the container 10, and a second end, referred to as the proximal end 14 of the container 10. The distal end 12 is opposite the proximal end 14 in the main direction X. Moreover, the distal end 12 of the container 10 is open in order to allow the product to pass through when said product occupies the first position (see FIG. 1).

FIG. 2 shows the container 10 in an arrangement that allows the product to occupy a second position. In said second position, the product is retracted inside the body 20 at least in part. It can be seen in this figure that, in this arrangement, the cup 40 is completely retracted inside the container 10 in order to allow a free end of the product to thus be substantially in the region of the distal end 12 of the container 10.

The body 20 further comprises a transparent portion 30. In the example shown here, the transparent portion 30 is located in the region of the proximal end 14 of the container 10.

The container 10 can also comprise a mechanism for moving the cup 40, referred to as the actuation mechanism of the container (not shown here). Said actuation mechanism is designed to move the cup 40 from a first position, referred to as the high position and that of FIG. 1 in this case, into a second position, referred to as the low position and that of FIG. 2 in this case, in which second position the cup 40 is completely retracted inside the container 10. The actuation mechanism is designed to cause the cup 40 to rotate and/or translate relative to the body 20. However, it should be noted that the invention is not limited to one particular type of actuation mechanism.

Thus, FIG. 1 corresponds to the first position of the product and shows the high position of the cup 40, the cup 40 then being located close to the distal end 12 of the container 10.

FIG. 2, which corresponds to the second position of the product, shows the low position of the cup 40, the cup 40 then being located close to the proximal end 14 of the container 10.

In this way, the transparent portion 30 makes it possible to see the cup 40 when it is in the low position, and therefore when the product occupies the second position.

The container 10 can comprise a blind part 34 at its proximal end 14, said blind part comprising the transparent portion 30. It is thus possible to see said cup 40 through said blind part 34 when said cup is in the low position. Said blind part 34 can be formed by a completely transparent material. In this case, just a lower portion of said blind part 34 is left transparent, and an upper portion is rendered opaque, for example by means of a coating.

In particular, in this case the cup 40 has a blind domed base, and it is the domed end of the cup 40 that is made visible from the outside due to the transparency of said blind part 34 (see FIG. 2).

It should be noted that said blind part 34 is separate from the body 20.

Furthermore, said blind part 34 can be part of the drive mechanism and make it possible to control the movement of the cup 40 relative to the body 20, in particular when said blind part 34 is actuated, for example rotated relative to said body 20. Said blind part can therefore have an outer surface that is intended to be handled by the user.

FIG. 3 shows the embodiment described above, the container 10 in addition being covered by an opaque cap 50. Said cap 50 conceals the product. It also conceals all or a portion of the body 40 and, as in this case, a region of the blind part 34, in particular a region 35 that makes it possible to retain said cap 50 in position on the container 10 (see FIG. 1 or 2 for the region 35).

The cap 50 is rigid and obtained by moulding, preferably from a plastics material. The cap can be protected, or even decorated, on the outer wall thereof. For example, said cap is provided with a layer of metallic material on its outer wall, which layer can be obtained by metallising said wall. Said layer can also be a thin strip of bonded plastics material.

The blind part 34 also has a height, in the main direction X, denoted h34 (see FIG. 3). The cap 50, in turn, has a height in the same direction X, denoted H50. The ratio between these two heights complies with following formula: $0.3 \leq h34/H50 \leq 0.7$. Thus, H50 can be substantially equal to 42 mm, and the height h34 can be substantially equal to 22 mm. Furthermore, the outer diameter of the blind part 34 is substantially the same as the outer diameter of the cap 50, for example between 18 mm and 22 mm, preferably substantially equal to 20 mm.

A recess 32 can be provided inside the blind part 34. Said recess 32 is intended to cooperate with the domed distal end of the cup 40, although it is not provided for these two parts to come into abutment. Indeed, a clearance J is provided between said blind part 34 and the distal end of the cup 40 (see FIG. 3). Said clearance can be substantially equal to 0.5 mm. This makes it possible to provide that the shape of the distal end of the cup 40 is not functionally linked to that of the blind part 34, in particular to that of the recess 32. The design of the actuation mechanism makes it possible to leave a clearance J of this kind between the distal end of the cup 40 and the recess 32 in the blind part 34, in particular when said mechanism moves the cup 40 into the low position.

In another embodiment (not shown here), the container 10 is designed such that said cup 40 abuts said blind part 34 in said second position of the product.

The invention has a particular application in the field of containers 10 for cosmetic products which do not have any indication on their outer wall regarding the product they contain. Indeed, the container 10 according to the invention makes it possible to provide an indication of its contents simply by seeing the cup 40 through the transparent portion 30, the cup 40 bearing an indication of this kind. It is thus sufficient to provide an indication on the cup 40 in order to inform the user about the contents of a container 10 of this kind. The invention can be applied particularly advantageously when the cup is provided in the same colour as the product that it is suitable for containing, the information about the product provided by the cup thus originating from the colour of the cup itself.

It should further be noted that variants are of course possible. In particular, in an additional embodiment (not shown), the cup 40 comprises two parts.

More specifically, the cup 40 can comprise a first part, referred to as the lower cup, that is designed to cooperate with the actuation mechanism, and a second part, referred to as the upper cup, that is suitable for receiving the product, the lower and upper cups being removable from one another. Thus, a user wishing to change the cosmetic product (stick used up, colour change desired) can keep the fixed assembly of "body 20, blind part 34 comprising a transparent portion 30, lower cup and cap 50" and only change the upper cup that is suitable for receiving the product. Indeed, the new upper cup is also provided so as to indicate the product that it contains, and it is not necessary to change the container as a whole since the fixed assembly of the container 10 according to the invention allows the cup 40 to be made visible through the transparent portion 30 of the blind part 34.

It should be noted that the embodiments above can be combined without departing from the scope of the invention. In particular, the cup 40 can have a layer of metallic material on its outer wall, which layer can be obtained by metallising said wall. Said layer can also be a thin strip of bonded plastics material.

The invention claimed is:

1. Container for a cosmetic product, in particular for a stick of cosmetic product, comprising a body and a cup that is movable relative to the body, the cup being suitable for receiving the product, said body comprising a transparent portion that makes it possible to see the cup in a position in which said cup is retracted inside the body; the container configured to allow the cup to occupy a first position, referred to as the high position, that is outside the body at least in part, and a position, referred to as the low position, that corresponds to the position in which the cup is radially visible through said transparent portion, wherein the cup is movable from the high position to the low position.

2. Container according to claim 1, further comprising a cap that is designed to cover said body, leaving said transparent portion visible.

3. Container according to claim 1, further comprising a blind part at the proximal end thereof, the blind part being designed in order for the cup to occupy said low position close to said blind part.

4. Container according to claim 3, designed such that said cup abuts said blind part in said low position.

5. Container according to claim 3, wherein said blind part comprises the transparent portion of the container.

6. Container according to claim 4, wherein said blind part comprises the transparent portion of the container.

7. Assembly of the container according to claim 1 and of said product, said cup providing information relating to said product.

8. Container according to claim 1 wherein the cup is a colored cup.

9. Container according to claim 8 wherein the colored cup is the color of said product.

* * * * *